United States Patent [19]

Pilotto et al.

[11] Patent Number: 4,609,118

[45] Date of Patent: Sep. 2, 1986

[54] CONVEX TYPE BOTTOM WITH A BEARING RIM FOR BOTTLES FOR INDUSTRIAL GASES OBTAINED BY MEANS OF HOT FORGING FROM A STEEL BILLET

[75] Inventors: Italo Pilotto, Castello di Godrego; Gerardo Bozzetto, Castelfranco Veneto, both of Italy

[73] Assignee: Simmel S.p.A.

[21] Appl. No.: 579,708

[22] Filed: Feb. 13, 1984

[30] Foreign Application Priority Data

Feb. 25, 1983 [IT] Italy ..... 19767 A/83

[51] Int. Cl.[4] ..... B65D 1/16; B65D 1/44

[52] U.S. Cl. ..... 220/3; 220/66; 220/70; 220/83; 220/DIG. 22

[58] Field of Search ..... 220/3, 66, 70, 72, DIG. 22, 220/83

[56] References Cited

U.S. PATENT DOCUMENTS

| | | | |
|---|---|---|---|
| 1,948,437 | 2/1934 | Bowers | 220/3 X |
| 2,274,173 | 2/1942 | Temple | 220/66 X |
| 3,889,835 | 6/1975 | Avant et al. | 220/66 X |
| 4,120,419 | 10/1978 | Saunders | 220/1 BC X |
| 4,147,271 | 4/1979 | Yamaguchi | 220/70 |

FOREIGN PATENT DOCUMENTS

| | | | |
|---|---|---|---|
| 234103 | 5/1960 | Australia | 220/66 |
| G 2883 | 5/1956 | Fed. Rep. of Germany | 220/70 |

*Primary Examiner*—Allan N. Shoap

[57] ABSTRACT

A convex type bottom with a bearing rim for bottles for industrial gases, obtained by hot forging a steel billet, has the lower outer surface consisting of a central circular flat area (2), a first frustoconical annular area adjacent the central area (2), inclined upwards, a second frustoconical annular area adjacent the first frustoconical annular area, inclined downwards, and a subvertical frustoconical area (6) radiused, on the one side, to the second frustoconical annular area and, on the other side, to the flat surface (7) of the bearing rim (8). Provided on the inclined frustoconical annular areas are corrugations (3,4,5). Such a configuration of the bottom permits the defects to be eliminated due to creeping of the material during forging.

2 Claims, 4 Drawing Figures

CONVEX TYPE BOTTOM WITH A BEARING RIM FOR BOTTLES FOR INDUSTRIAL GASES OBTAINED BY MEANS OF HOT FORGING FROM A STEEL BILLET

The present invention relates to bottles for industrial gases obtained by hot forging a steel billet and more particularly to convex type bottoms with a bearing rim for said bottles, corresponding to the international standard ISO/DIS 4705.

The first step in the construction of said bottles consists of the extrusion of the steel billet. In this operation the steel billet heated to the forging temperature is first pressed so as to fully fill the die. Subsequently, by means of a punch shaped according to the inner profile of the forging billet, the indirect extrusion step proper is carried out. In this step the material, due to the pressure generated by the punch, creeps first laterally and then, through the space between the punch and the outer containment die, upwards and generates the thick forging billet which will be reduced subsequently, in the drawing step, to the final thickness.

The last step of the punch stroke is the critical point because it generates a defect on the outer surface which is localized at the radiused portion of the bearing rim. This defect appears as an inclusion of slag and material used for the lubrication of the die.

This phenomenon is clearly generated by a movement of the material in contact with the stripper or ejector which in said critical step advances first in a direction parallel to the stripper and then upwards with an inclination, in the area in question, of 45°–60° and draws the outer impurities inside the work.

At present the manufacturers of bottles obtained from a billet and with a bearing rim eliminate this defect by means of a subsequent machining on chip removing machine tools. This apparently weights disadvantageously on the cost of the bottles.

It is the object of the present invention to eliminate the above mentioned defect of the prior art bottles of this type.

More particularly, the convex type bottom for a bottle for industrial gases according to the invention with a bearing rim is characterized in that the lower outer surface of its wall comprises a flat circular central area, a first frustoconical annular area adjacent the central area, inclined upwards, a second frustoconical annular area adjacent the first annular area, inclined downwards, and a subvertical frustoconical area radiused on the one side to the second frustoconical annular area and on the other side to the flat surface of the bearing rim.

According to a feature of the invention provided on the two annular inclined areas are corrugations whose center line corresponds to the generatrix of the respective area.

According to another feature of the invention the ratio between, on the one side, the distance of the center of the radius of the area connecting the inner surface of the bottom to the inner surface of the cylindrical wall of the forging billet, from the plane of the central flat area and, on the other side, the outer diameter of the cylindrical wall of the forging billet is near the minimum 0.2 value allowed for the shape of the convex type bottom by the international standard ISO/DIS 4705.

According to a further feature of the invention, the outer side surface of the bottom has two adjacent subvertical annular areas having a different taper.

A bottom having the above specified features is free of the defect due to the creeping of the billet material in contact with the stripper during the bottom forming step. This is mainly due to the fact that the particular shape of the stripper, which being the negative of the outer surface of the bottom to be formed has two annular areas inclined in different directions and provided with corrugations, determines an irregular cross-section for the flow of the material and slows down its creeping which is further slowed down because of the increase in the surface of contact between the bottom being formed and the stripper. A further reason why the material is slowed down in its creeping is due to the particular choice of the ratio between, on the one side, the distance of the center of the radiused area between the inner surface of the bottom and the inner surface of the cylindrical wall of the forging billet, from the plane of the central flat area and, on the other side, the outer diameter of the forging billet. Another reason which helps to slow down the creeping of the material is the particular configuration of the surface of the containment die at that bottom of the forging billet.

The invention includes also a fixture for forming the bottom comprising a stripper having the top surface with a central circular flat area, a first frustoconical annular area adjacent the central area, inclined upwards, a second frustoconical annular area adjacent the first frustoconical annular area, inclined downwards, and a subvertical area radiused on the one side to the second frustoconical annular area and on the other side to a flat annular area; a containment die having near its lower end two subvertical frustoconical annular areas having a different taper; and a punch having the ratio between, on the one side, the distance of the center of the radius of the area connecting bottom surface to the side surface of the punch, from the plane of the central flat area, and, on the other side, the inner diameter of the containment die at its cylindrical section, near the minimum 0.2 value allowed for the convex type shape of the bottom by the international standard ISO/DIS 4705.

The invention will be better understood from the following description, given merely as an example and therefore in no limiting sense, of an embodiment thereof, referring to the accompanying drawings, in which.

Figure 1:
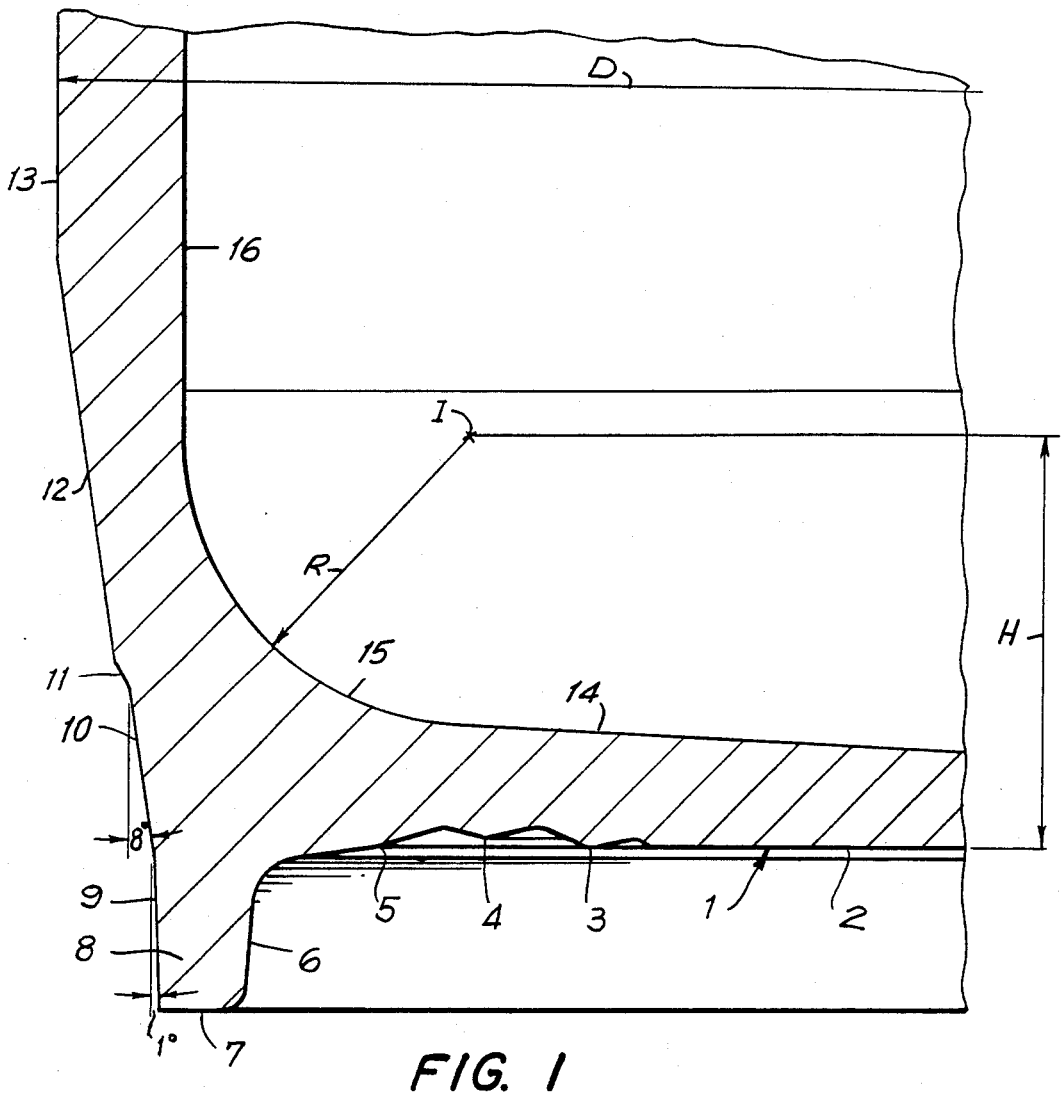
FIG. 1 is an axial, fragmentary, cross-sectional view, of a bottle bottom according to the invention.

Referring to FIG. 1, the bottom 1 of the bottle has outwards and downwards of the bottle a surface comprising essentially a central circular flat area 2 and three corrugations 3,4,5 disposed along adjacent annular areas, concentric to the area 2. As will be explained better hereinafter when describing the stripper used for forming the bottom, said corrugations are not disposed at random but according to an accurate geometry which has been purposely studied in order to eliminate the above mentioned defect, common to prior art bottles of this type. The corrugation 5 is radiused to a subvertical frustoconical area 6 which is in turn radiused, at the other end, to an annular bearing area 7 of the rim 8 provided in these types of bottoms. The outer side surface of the bottom has subvertical frustoconical areas 9,10, the taper of the area 9 being substantially lower than that of the area 10. The latter area is connected by means of a narrow area 11 having a larger taper to an area 12 connecting the bottom with the cylindrical vertical section of the forging billet whose outer cylindrical surface is referred to as 13.

The inner bottom surface of the bottle has a slightly dished area 14 connected by means of an area 15 with a radius R to the inner cylindrical surface 16 of the forging billet. D designates the diameter of the outer cylindrical surface 13 of the forging billet.

Figure 2:
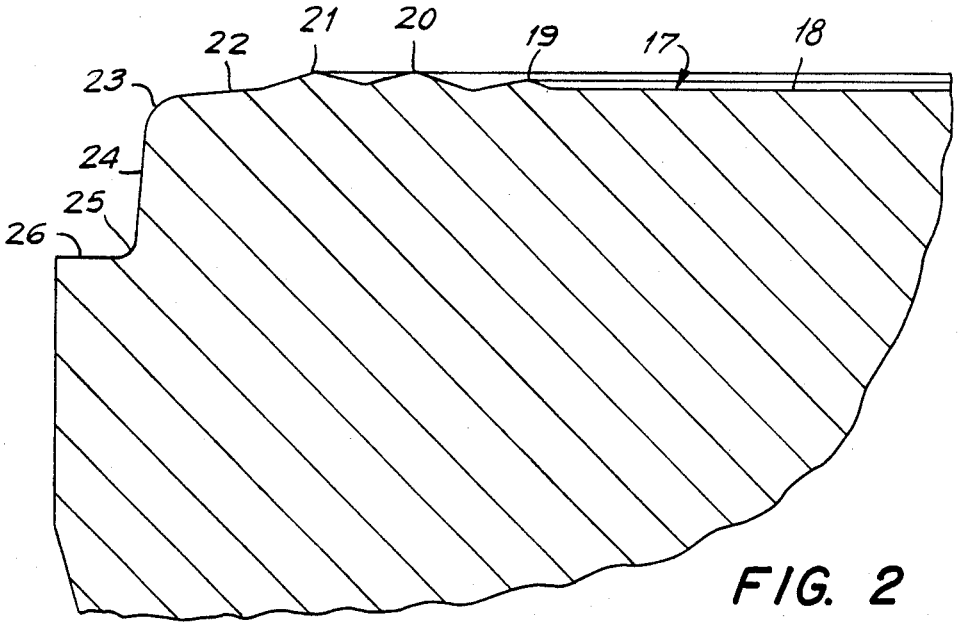
FIG. 2 is an axial, fragmentary, cross-sectional view of a stripper used for forming a bottom according to FIG. 1.
Figure 3:
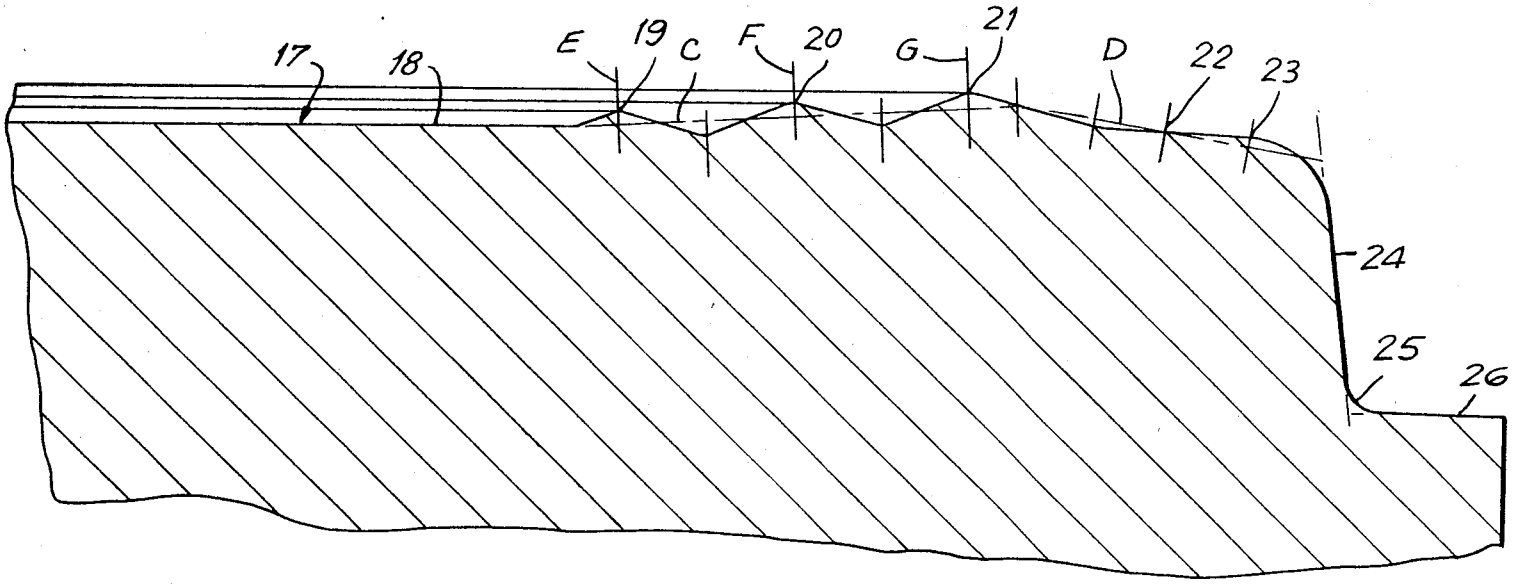
FIG. 3 is an axial, fragmentary, cross-sectional view, to an enlarged scale, of the stripper of FIG. 2.
Figure 4:
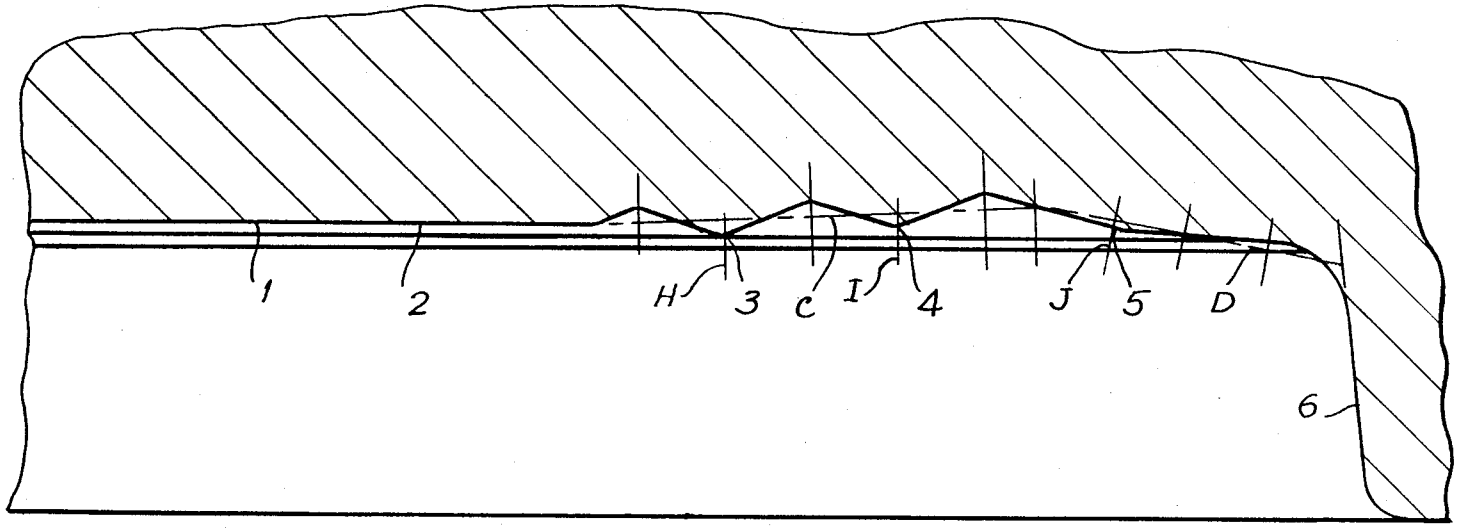
FIG. 4 is an axial, fragmentary, cross-sectional view, on an enlarged scale, of the bottle bottom of FIG. 1.

In order to well understand the principle on which has been based the design of the shape of the bottom in order to eliminate the above specified defect, reference should be made to the stripper 17 shown in FIGS. 2 and 3. As is best seen in FIG. 3, the upper outer surface of the stripper 17, which is obviously the negative of the lower outer surface of the bottom 1, comprises essentially a circular central flat area 18 and three corrugations 19,20,21 disposed along adjacent annular areas, concentric to the area 18. Said corrugations are disposed in such a manner that their center line corresponds to the two adjacent frustoconical areas, the first inclined upwards from the circumference of the central circular flat area and represented by the generatrix C and the second inclined downwards from the first inclined area and represented by the generatrix D'. Specifically, corrugations 19, 20, 21 are disposed along and extend from the generatrix C, D' of the respective first and second frustoconical annular areas, and lines E, F, G drawn through the centers of respective corrugations 19, 20, 21 intersect the generatrix C, D'. Similarly, as best seen in FIG. 4, corrugations 3, 4, 5 of the bottle bottom 1 are disposed along and extend from the generatrix C, D' of the corresponding first and second frustoconical areas of the bottle bottom, and lines H, I, J drawn through the centers of respective corrugations 3, 4, 5 intersect the generatrix C, D'. In a practical embodiment the area C has a 5° inclination with respect to the area 18 and the area D has a 15° inclination in an opposite direction with respect to the area 18. It has been surprisingly found that by means of a stripper of the described configuration a bottom 1 is obtained which is free of outer defects such as laps and wrinkles due essentially to a radial creeping effect of the material during the extrusion step. In addition, what is more important, a bottom of such a configuration has no inclusions of slag and die lubricant in the area connecting the bottom proper to the rim.

The upper surface of the stripper 17 is completed, starting from the corrugation 21, by a subhorizontal frustoconical area 22, a curved area 23, a subvertical frustoconical area 24, a further curved area 25 and an annular area 26.

According to a feature of the invention it has been found that another parameter helping to eliminate the defects in the bottle bottom is the choice of a ratio of the height H (see FIG. 1) to the outer diameter D of the forging billet near the minimum 0.2 value allowed for the type "E" configuration by the standard ISO/DIS 4705 and the international standards. As is seen in FIG. 1 the height H is the distance between the center I of the radius R of the surface connecting the inner surface of the bottom to the inner surface of the forging billet and the plane of the central flat surface 2.

It has been also found that a contribution to the elimination of the above mentioned defects is the choice of a forging billet containment die such as to provide in the outer side surface of the bottom two subvertical frustoconical areas having a different taper. In a practical embodiment the taper of the area 9 contiguous to the bearing area 7 of the bottom was 1° and that of the area 10 contiguous to it was 8°.

These two parameters, the ratio $H/D \cong 0.2$ and the shape of the lower faces of the containment die determining a large thickness wall, together with the particular inclined areas of the stripper, determine a gradually increasing cross-section for the flow of material and favor thus a decrease in the creeping speed of the material. Finally, the corrugations provided on the surface of the stripper by producing a double effect of widening and narrowing as well as increasing the surface of contact between the bottom and the stripper permit the movement of the material to be stopped and the probability that the outer defect be formed to be eliminated.

At present the manufacturers of bottles obtained from a billet and with a bearing rim use a different geometry of the bottom with a much higher H/D ratio than the minimum allowable ratio.

This fact combined with the requirement that the height of the bearing rim be such as to provide a grip for the manual handling of the bottle prevents the obtention of a bottom fully free of the illustrated defect.

It is therefore necessary to machine, in a subsequent step and by means of a chip producing machine tool, the area in question.

In addition, it is normal practice, because of the high weight of a so dimensioned bottom, that the machining is extended to the whole outer surface of the bottom to obtain a weight reduction considering the importance this parameter has in the use and marketing of the bottles for the transportation of industrial gases.

While but one embodiment of the invention has been illustrated and described, it is obvious that a number of changes and modifications can be made without departing from the scope of the invention.

We claim:

1. A convex type bottom for bottles for industrial gases obtained by hot forging a steel billet into a bottle having a cylindrical wall including an inner surface (16) and a bottom joined to said cylindrical wall at the lower end thereof, said bottom including an annular, bearing rim having a flat surface (7) for supporting the bottle, a lower outer surface radially inwardly and above said annular, flat surface and an upper inner surface (14) opposing said lower outer surface, said upper inner surface connected to said inner surface of said cylindrical wall by a curved area having a radius (R), the bottom characterized in that the lower outer surface of said bottom comprises a flat circular central area (2), a first frustoconical annular area represented by the generatrix (C) adjacent the central area and inclined upwards by approximately 5 degrees, a second frustoconical annular area represented by the generatrix (D') extending from adjacent the first frustoconical annular area and inclined downwards by approximately 15 degrees, and a near vertical frustoconical area (6) joined at its upper end to the second frustoconical annular area (D') and on its lower end to the annular, flat surface (7) of the bearing rim, the bottle bottom formed so as to have a ratio (H/D) between the distance (H) measured from the center of the radius (R) of the area connecting the inner upper surface of the bottom (14) to the inner surface of the cylindrical wall (16) of said bottle to the plane of said flat circular central area (2) and the outer diameter (D) of the cylindrical wall of the forging billet which is near a minimum value of 0.2, and said first and second frustoconical annular areas provided with corrugations (3,4,5) which are formed along and extend from the generatrix (C,D') of the respective first and second frustoconical annular areas so that lines (H,I,J) drawn through the centers of respective corrugations (3,4,5) intersect the respective generatrix (C,D'), and there are two corrugations provided with respect to said first frustoconical annular area and one corrugation provided with respect to said second frustoconical annular area.

2. A bottom as claimed in claim 1, characterized in that the outer side surface of the bottom above said annular, flat surface has two adjacent near vertical frustoconical annular areas (9,10) having a different taper, the taper of the lower area (9) being lesser than the taper of the upper area (10) and equal to about 1 degree, the height of the upper end of the upper area (10) with respect to the plane of the annular, flat surface (7) being about 20 percent of the outside diameter (D) of the bottle, the lower area being generally opposed to said near vertical frustoconical area joining said annular flat surface and said second frustoconical annular area.

* * * * *